US007846298B2

(12) United States Patent
Thorgersen et al.

(10) Patent No.: US 7,846,298 B2
(45) Date of Patent: Dec. 7, 2010

(54) OUTLET DEVICE FOR A PRESSURIZED VESSEL HAVING A COMBINED RADIAL BEARING AND HYDRAULIC DRIVE MOTOR

(75) Inventors: Peter E. Thorgersen, Gansevoort, NY (US); Ronald G. Bain, Salem, NY (US); Keith Vogel, Queensbury, NY (US); Tim Pease, South Glens Falls, NY (US)

(73) Assignee: Andritz Inc., Glens Falls, NY (US)

( * ) Notice: Subject to any disclaimer, the term of this patent is extended or adjusted under 35 U.S.C. 154(b) by 261 days.

(21) Appl. No.: 12/102,485

(22) Filed: Apr. 14, 2008

(65) Prior Publication Data

US 2008/0257511 A1 Oct. 23, 2008

Related U.S. Application Data

(60) Provisional application No. 60/913,421, filed on Apr. 23, 2007.

(51) Int. Cl.
*D21C 7/02* (2006.01)

(52) U.S. Cl. ..... 162/244; 162/246; 277/510

(58) Field of Classification Search ..... 162/244, 162/246; 384/420; 91/491; 277/510
See application file for complete search history.

(56) References Cited

U.S. PATENT DOCUMENTS

| | | | | |
|---|---|---|---|---|
| 6,368,453 | B1 * | 4/2002 | Kettunen et al. | 162/52 |
| 2002/0121745 | A1 * | 9/2002 | Vogel et al. | 277/510 |
| 2003/0089468 | A1 * | 5/2003 | Kettunen et al. | 162/19 |

* cited by examiner

*Primary Examiner*—Mark Halpern
(74) *Attorney, Agent, or Firm*—Nixon & Vanderhye P.C.

(57) ABSTRACT

An outlet device and motor assembly for a pressured vessel is disclosed, where the assembly includes: a generally vertical drive shaft extending below and through the vessel and coupled to a rotating mechanism within the vessel; a stationary outlet housing supporting the drive shaft; a thrust bearing mounted on the outlet housing and around the drive shaft to rotationally engage the drive shaft; a hydraulic drive coupled to rotationally drive the drive shaft, and a radial bearing mounted around the drive shaft to rotationally engage the drive shaft and said radial bearing is at or below the hydraulic drive.

18 Claims, 8 Drawing Sheets

OUTLET DEVICE FOR A PRESSURIZED VESSEL HAVING A COMBINED RADIAL BEARING AND HYDRAULIC DRIVE MOTOR

RELATED APPLICATION

This application claims the benefit of U.S. Patent Application Ser. No. 60/913,421 filed Apr. 23, 2007, which is incorporated by reference in its entirety.

BACKGROUND OF THE INVENTION

This invention relates to pressurized vessels having rotating internal components. In particular, this invention relates to a rotating shaft to drive a stirrer in a pressurized agitator and digester vessels.

The pulp and paper industry, as well as other process industries, employ chemical reactions in processes that are often performed under pressures greater than atmospheric pressure. Typically, these processes are performed within vessels that maintain the product at predetermined super-atmospheric pressures and at elevated temperatures that promote the desired chemical reaction. A continuous or batch pulp digester vessel are examples of vessels within which are performed chemical reactions under elevated pressures and temperatures.

The processes being performed often require agitation or stirring of the product in the vessel during the chemical reaction and while the product is under pressure and at elevated temperatures. The agitation is typically effected by a shaft-driven agitator. An electric motor drives the shaft via a power transfer device, such as a transmission, that may include belts, drive chains and a gear reducer.

The drive shaft of the agitator penetrates the wall of the pressure vessel. Bearings support the drive shaft. The bearings are mounted in an outlet housing below the digester vessel. The bearings reduce the friction between the rotating or reciprocating shaft and the support housing. Typically, the bearings are roller bearings, such as spherical and cylindrical anti-friction bearings, or journal bearings that are self-lubricating or have reduced-friction properties. Conventionally, two bearings are arranged along a length of the drive shaft. Both bearings are above the power transfer devices which engages a bottom end of the drive shaft. The two bearings generally include a thrust-radial bearing and a radial bearing. The thrust-radial bearing supports axial loads applied to the drive shaft by the digester. The thrust-bearing prevents substantial axial forces from being applied power transfer device coupled to the drive shaft. The thrust-bearing and radial bearing support the shaft with respect to radial forces, isolate the power transfer device from radial and axial loads applied by the digester to the shaft, and prevent the shaft from wobbling during rotation.

The drive shaft is intentionally relatively long to accommodate the two bearings and to prevent shaft wobbling due to force moments resulting from the application of radial forces. The bearings are conventionally separated by a substantial distance, such as two to three feet. The separation distance requires the length of the drive shaft to be relatively long below the digester. The digester must be sufficiently elevated to accommodate the long drive shaft and the power transfer device. In certain digester applications, it is difficult to elevate the digester vessel sufficiently to accommodate a long drive shaft and the power transfer device, e.g., a gear box transmission. Sufficient ground clearance between the digester vessel and the outlet housing is also needed to install an extended outlet housing and associated drive shaft where the outlet housing is extended to include a conduit for wash liquor flowing into the vessel. For at least applications where ground clearance of the vessel is a concern, there is a need for an outlet housing having a short drive shaft and, preferably, an associated short transmission.

BRIEF DESCRIPTION OF THE INVENTION

An outlet device and motor assembly for a pressured vessel is disclosed, where the assembly includes: a generally vertical drive shaft extending below and through the vessel and coupled to a rotating mechanism within the vessel; a stationary outlet housing supporting the drive shaft; a thrust bearing mounted on the outlet housing and around the drive shaft to rotationally engage the drive shaft; a hydraulic drive coupled to rotationally drive the drive shaft, and a radial bearing mounted around the drive shaft to rotationally engage the drive shaft and said radial bearing is at or below the hydraulic drive.

An outlet device and motor assembly for a pressured vessel is disclosed comprising: a generally vertical drive shaft extending below and through the vessel and coupled to a rotating mechanism within the vessel; a stationary outlet housing supporting the drive shaft; a thrust bearing mounted on the outlet housing and around the drive shaft to rotationally engage the drive shaft, and a hydraulic drive coupled to rotationally drive the drive shaft, wherein the hydraulic drive further comprises a radial bearing which supports the drive shaft.

A shaft outlet assembly and drive assembly for a digester comprising: a rotatable shaft extending from the outlet assembly into a pressurized vessel of the digester; a pack box mounted to the housing and having packing around the shaft; a stationary outlet housing supporting the drive shaft; a thrust bearing mounted in the outlet housing and around the drive shaft to rotationally engage the drive shaft, and a hydraulic drive coupled to rotationally drive the drive shaft, wherein the hydraulic drive includes a radial bearing which supports the drive shaft.

A method for supporting and driving a drive shaft of a digester, wherein the digester has a drive shaft extending through a bottom header and the drive shaft is supported by an outlet device attached to the bottom header, the method comprising: adsorbing radial and axial forces applied by the digester to the drive shaft with a bearing in the outlet device; rotationally driving the drive shaft with a hydraulic drive assembly connected to the drive shaft and fixed to the outlet device, and adsorbing radial forces acting on the drive shaft with the hydraulic drive assembly.

An outlet device and motor assembly for a pressured vessel comprising: a generally vertical drive shaft extending below and through the vessel and coupled to a rotating mechanism within the vessel; a stationary outlet housing supporting the drive shaft; a thrust bearing mounted on the outlet housing and around the drive shaft to rotationally engage the drive shaft, and a hydraulic drive coupled to rotationally drive the drive shaft, wherein the hydraulic drive includes a radial bearing.

DETAILED DESCRIPTION OF THE INVENTION

Although this invention is described in context to what is known in the art as an "outlet device" for a continuous agitator or digester vessel, it is understood that this invention is applicable to any shaft, either rotating or reciprocating or stationary, that penetrates the wall of a fluid containing vessel that may be pressurized or unpressurized.

Figure 1:
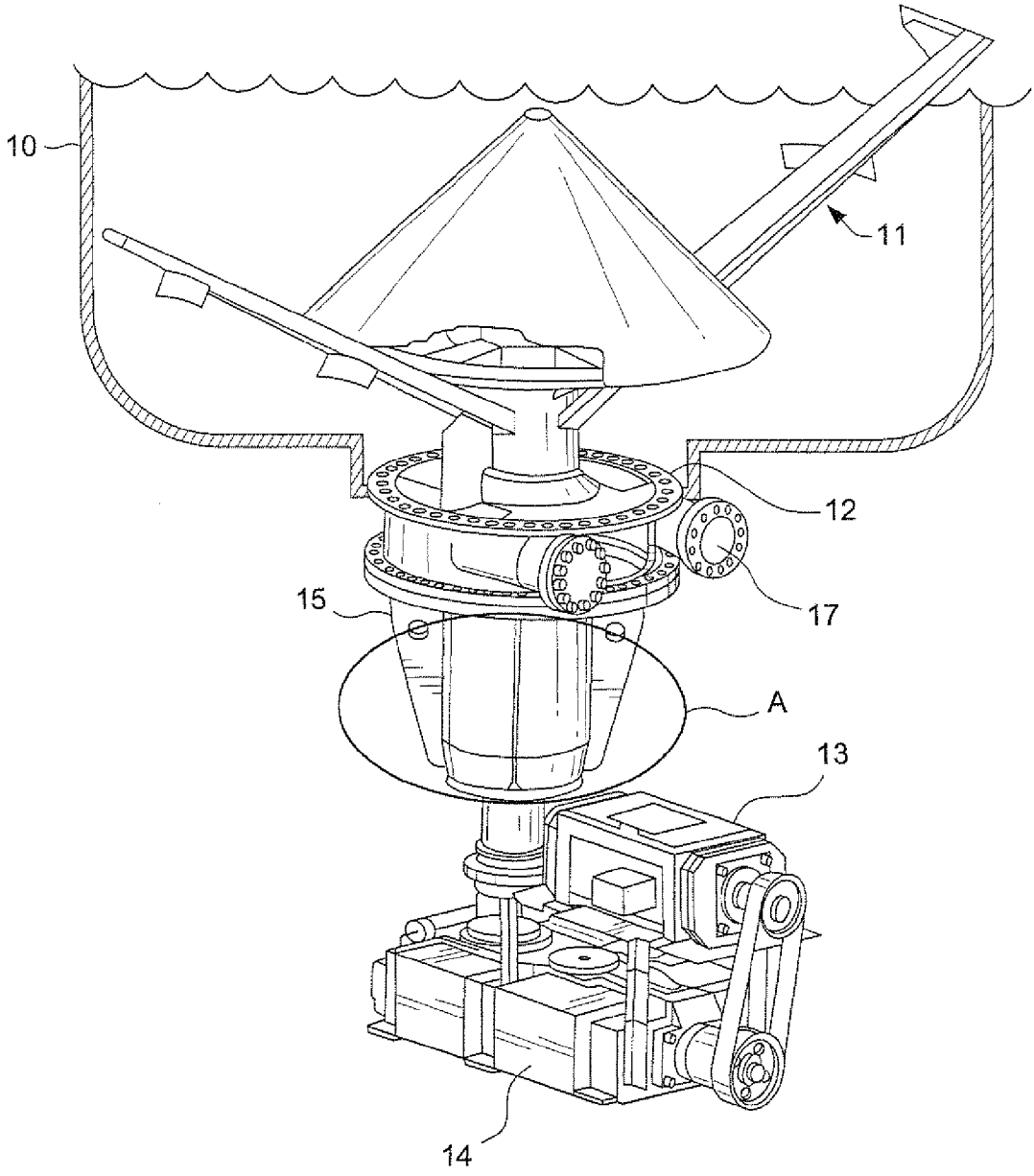
Figure 1 (Prior Art)
FIG. 1 is a perspective view, with portions of the vessel cut away for clarity of illustration, of a conventional prior art vessel with drive shaft and shaft operating and supporting components.

FIG. 1 illustrates the bottom section 10, of a conventional continuous digester, such as sold by Andritz Inc. of Glens Falls, N.Y. This vessel is used for the continuous chemical pulping of comminuted cellulosic fibrous material, for example, wood chips. The comminuted cellulosic fibrous material enters the top of the vessel (not shown) and passes downward as it is treated with pulping chemicals at superatmospheric pressure, typically 1.1 bar to 20 bar (15 to 300 psi), preferably 5 to 15 bar (70 to 220 psi), and at a temperatures greater than 100° C., typically between 130° C. and 180° C.

After the pulping reaction is essentially completed, the pulped comminuted cellulosic fibrous material is discharged from the bottom of the digester 10, by means of a rotating bottom scraper device 11, mounted in the bottom head 12 of the digester. Processed pulp and some liquor flow through the interior of the bottom head 12 and out the pulp outlet 17 at the bottom head of the digester.

The bottom scraper 11 is supported within the pressurized vessel (digester) 10 by an outlet device 15 which includes bearings to support the weight and load of the rotating device, e.g., the bottom scraper, and seals to prevent leakage of process fluids from the vessel through the outlet device. The outlet device is below the digester vessel and is attached to the bottom head 12 of the vessel. The outlet device houses a drive shaft 21 (shown in FIGS. 2A and 2B) that turns the bottom scraper 11 in the digester vessel. The outlet device 15 is typically driven by an electric motor 13, via a transmission 14, e.g., a speed reducer. In this application, the outlet drive is typically driven at a speed between 1 and 20 rpm (revolutions per minute), preferably, 5 to 15 rpm, though in other applications the shaft rotational speed may be higher. The motor and transmission are directly connected to the drive shaft but are generally not fixed to the outlet device 15. Further, the motor and transmission are insulated from axial and radial forces acting on the drive shaft and do not adsorb such forces. The motor and transmission apply a rotational drive force to the shaft, but are otherwise largely insulated from forces applied to or received forces from the drive shaft.

Figure 2A:
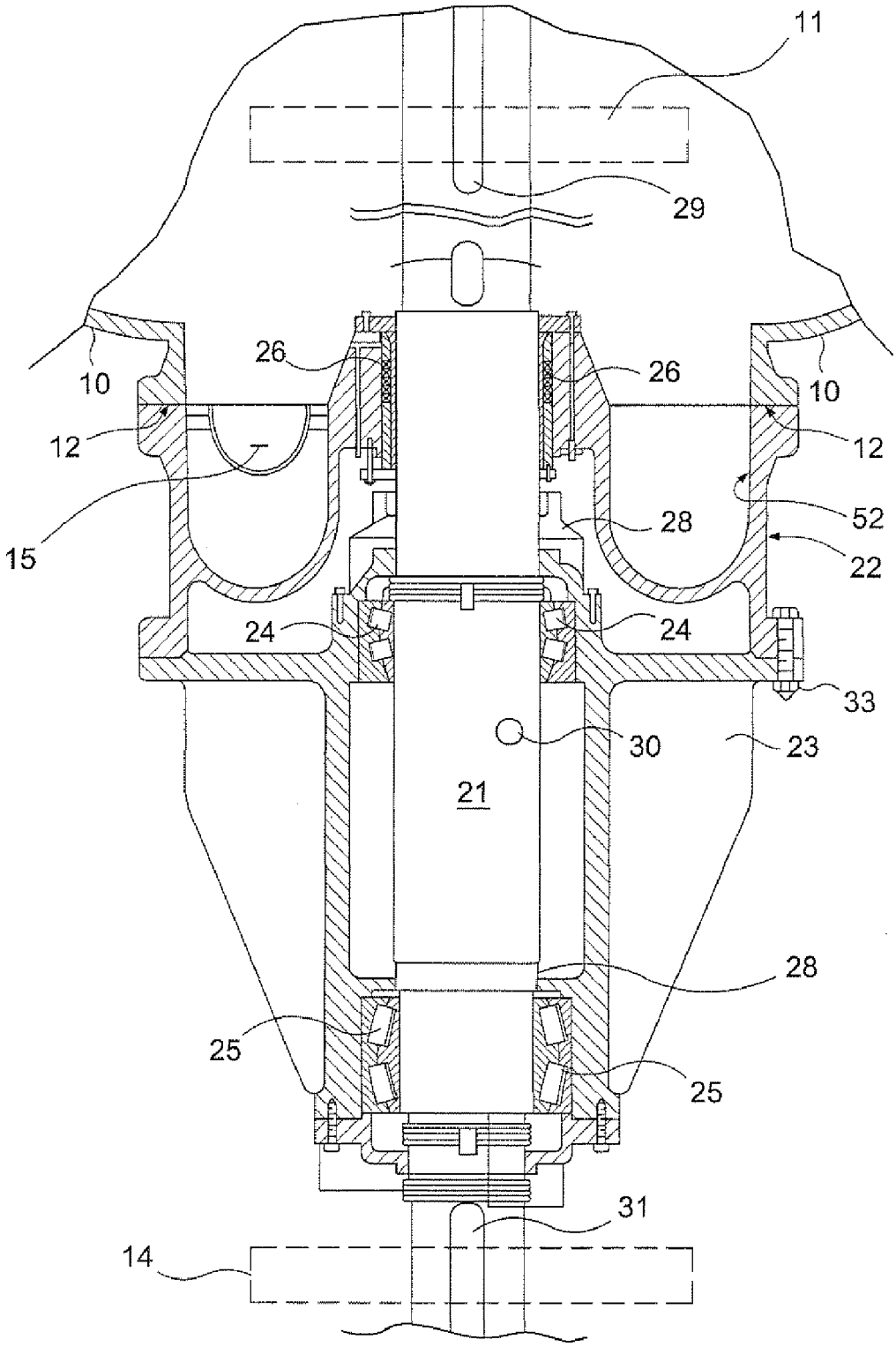
Figure 2A (Prior Art)
FIGS. 2A and 2B are detailed side views, partly in cross-section and partly in elevation, of the area A of FIG. 1, showing two embodiments of conventional long drive shafts, outlet housings and drive transmissions.
Figure 2B:
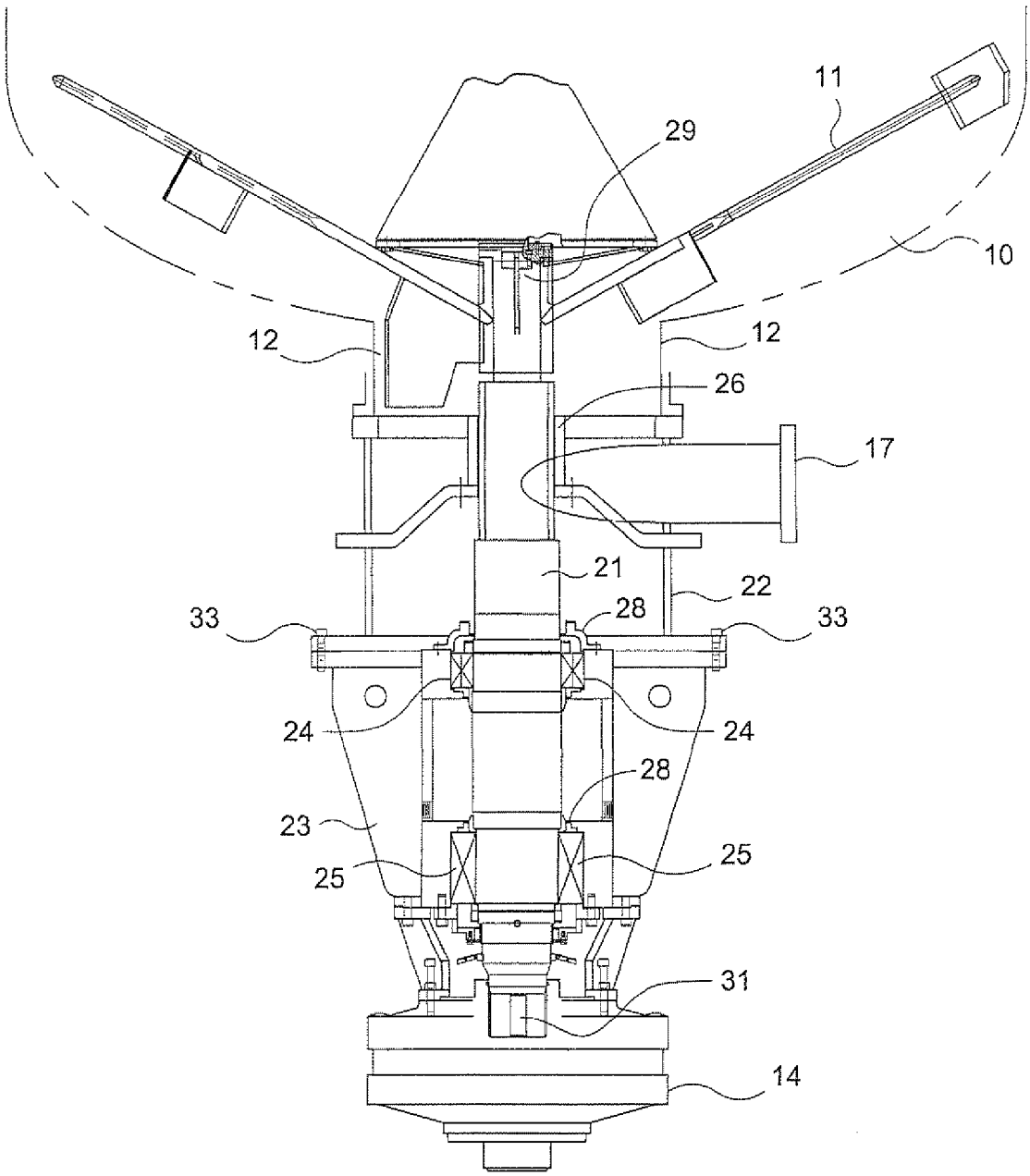
Figure 2B (Prior Art)

FIGS. 2A and 2B show a elongated drive shaft 21, having a first end with a drive key 29, which engages the bottom scraper 11, shown in FIG. 1, and a second end having a second key 31, which engages a drive transmission 14, for example, a speed reducer, motor or gear box. The upper end of the shaft is within the pressure vessel and the lower end is outside the pressure vessel. The shaft 21 rotates about an axis that is typically vertical. The outlet device 15 may include an upper housing 22, which attaches to the bottom head 12 of the bottom section 10 of the digester.

The upper interior surfaces 52 of the upper housing of the outlet device are inside of the digester and exposed to the pressurized fluid in the pressurized vessel of the digester. A lower housing 23 of the outlet device attaches to the upper housing 22 via bolts or studs 33. This assembly of housings for the outlet device includes upper and lower roller bearing assemblies 24 and 25, and at least an upper packing or seal assembly 26 that forms an annular fluid-tight seal around the shaft 21 to prevent leakage of product from the vessel around the shaft. The upper roller bearing assembly 24 may be a radial bearing and the lower roller bearing assembly 25 may be a thrust-radial bearing. The shaft 21 may also include one or more liquid deflectors or "flingers" 28, which protect the bearing assemblies 24, 25 from leakage around the shaft from above the bearing assemblies.

The bearing assemblies 24, 25 may be separated by 34 to 35 inches, e.g., 80 to 90 centimeters, to ensure that the bearings adsorb radial forces on the shaft 21, counteract force moments applied to the shaft by the radial forces and ensure that the shaft does not wobble. The outlet device 15 and transmission 14 extend approximately 103 inches, e.g., 2.5 meters, below the bottom of the digester vessel. In such an arrangement, a ground clearance of at least 112 inches, e.g., 2.8 meters, is generally conventionally needed below the digester to allow for the long drive shaft and drive transmission.

Figure 3:
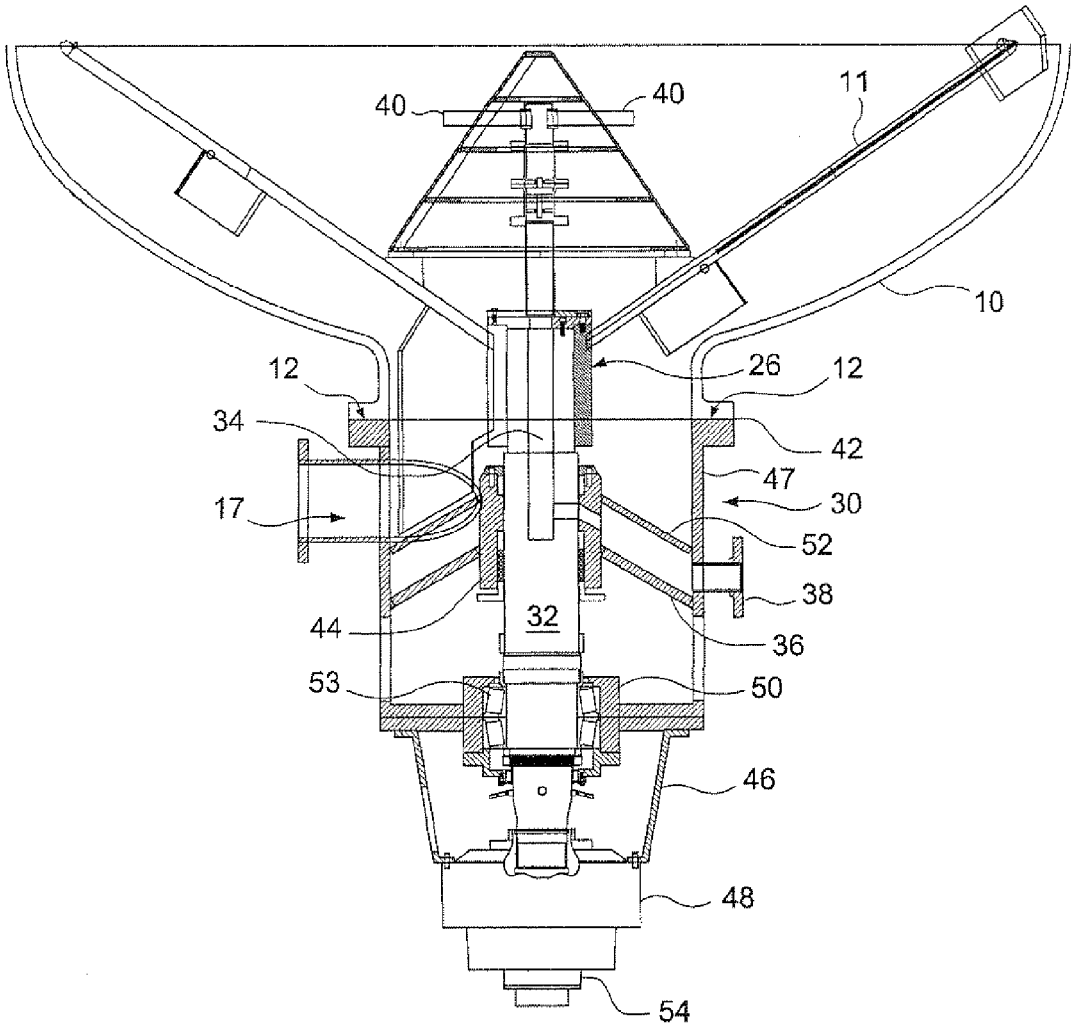
FIG. 3 is a side view, partly in cross-section and partly in elevation, of a short drive shaft, short outlet housing and a hydraulic shaft drive.

FIG. 3 shows an a novel outlet device 30 having a short vertical drive shaft 32 extending through a bottom head 12 of the digester vessel 10 and into the pressurized vessel of the digester to rotationally drive a scraper 11 in the vessel. Processed pulp and some liquor flow through the interior of the bottom head 12 and out the pulp outlet 17 of the outlet device below the bottom head of the digester vessel.

The outlet device 30 includes a stationary housing 47 that has an upper end flange 42 that connects to the bottom head 12 of the digester and a lower inverted conical chamber 46 that is fixed to a drive assembly 48, such as a hydraulic motor spline drive, hydraulic transmission or hydraulic drive assembly. Hydraulic drives also tend to be shorter than conventional gear boxes and other conventional transmissions for drive shafts. The stationary outlet housing 47 has a thrust bearing assembly 50 that supports a thrust roller bearing 53. The thrust bearing assembly 50 may be at the lower end of the outlet housing 47. The thrust roller bearing provides radial and axial support for the drive shaft 32. The thrust bearing assembly 50 and outlet housing 47 adsorbs the axial and radial forces that act on the drive shaft from the upper digester and insulate the drive assembly 48 from most of these forces. The outlet device 30 need not include a conventional second bearing (see for comparison roller bearing 24 in FIGS. 2A and 2B) to adsorb radial forces acting on the shaft and to prevent force moments from wobbling the shaft about the thrust bearing assembly 50.

The drive shaft 32 extend through the outlet housing and is supported the thrust bearing assembly 50 and a lower radial bearing 54 integral with the hydraulic transmission and motor assembly. The lower radial bearing receives and supports the lower end of the drive shaft 32. The bearings reduce the friction between the rotating or reciprocating shaft and the outlet housing 47. The bearings 53, 54 may be roller bearings, spherical and cylindrical anti-friction bearings or journal bearings that are self-lubricating or have reduced-friction properties. The pair of bearings 53, 54 generally include a thrust-radial bearing and a radial bearing. Preferably the upper bearing 53 is a thrust bearing and the lower bearing assembly 54 includes a radial bearing, although the upper bearing assembly may be a radial bearing and the lower bearing assembly may be a thrust bearing assembly. The thrust-bearing and radial bearing 53, 54 support the shaft with respect to radial forces, isolate the power transfer device from radial and axial loads applied by the digester to the shaft, and prevent the shaft from wobbling during rotation.

Packing material in a pack box 26 surrounds the drive shaft and provides a seal between the drive shaft and the interior vessel of the digester. The pack box is generally aligned with the interface between the bottom header 12 and the upper flange 42 of the outlet device 30. The pack box may be mounted on the outlet housing or on the vessel, particularly the bottom header 12 of the vessel. By having the pack box on the vessel, the outlet housing may be shortened as is does not support the pack box. The pack box has an open inside side facing the drive shaft and providing a seat for the packing material.

The hydraulic drive assembly 48 transmits radial forces to the outlet device 30, in addition to applying torque to rotate the drive shaft. To counteract such radial forces, the hydraulic drive assembly 48 includes the integral bearing assembly 54, e.g., a radial bearing or a thrust bearing, around the drive shaft 32 to adsorb radial forces acting on the shaft and prevent moments from causing the shaft to wobble. The integral thrust bearing assembly 54 may be arranged below the drive transmission and hydraulic motor of the drive assembly 48. The distance between the upper thrust bearing assembly 50 and the lower integral thrust bearing assembly 54 is sufficient to counteract moments applied to the shaft 32 due to radial forces, such as applied by the drive assembly 48. The distance between the bearing assemblies 50, 54, may be, for example, two to three feet or 0.5 to one meter.

The drive shaft 32 may include a hollow section 34 such that counter-wash liquor may flow up through the hollow portion of the shaft from an annular fluid coupling 36 that receives the wash liquor from an inlet port 38. The wash liquor may be injected from nozzles 40 that rotate with the scrapper 11. The nozzles may be above, below or at the same elevation as the arms of the scraper 11. A second packing box 44 immediately below the wash liquor coupling 36 seals the shaft 32 with respect to the coupling 36.

Conventional wash liquor couplings typically require an extended drive shaft to accommodate the liquor inlet and coupling. To add a conventional wash liquor coupling and inlet, the drive shaft may have had to have be extended to accommodate both the lower bearing assembly and the newly added wash liquor coupling. However, a conventional wash liquor coupling and associated inlet may not be practically added to a digester vessel if there is insufficient clearance below the digester vessel to extend the shaft.

An advantage of the outlet device 30 disclosed herein allows for a wash liquor coupling to be added to the outlet device 30 without extending the drive shaft and possibly while the drive shaft 32 is shortened. For example, a counter wash coupling 36 and inlet 38 may be added to the outlet device 30 in circumstances where there is a short ground clearance below the digester vessel. The drive shaft may be shortened or need to be extended to add a wash liquor coupling, because the outlet device does not include a lower bearing (see 25 in FIGS. 2A and 2B) that would otherwise interfere with the addition of a wash liquor coupling.

The drive shaft 32 may be shorted (or remain short in comparison to a conventional drive shaft) because the outlet device does not include a second bearing and the associate bearing housing, such as shown as bearings 25 in FIGS. 2A and 2B. For example, the hydraulic drive assembly 48 and outlet device 30 with a counter wash coupling 36 and inlet 38 may have a combined length of 91 to 92 inches. In contrast, the conventional outlet device 15 and gear box 14 shown in FIGS. 2A and 2B may have a combined length of 103 inches. In this example, the combined hydraulic drive 48 and short outlet device 30 are nearly one foot shorter and have an additional counter-wash system. If the counter-wash system had not been added, the outlet device could have been another foot shorter. By replacing the gear box with a hydraulic motor drive and by doing away with a second bearing in the outlet device, the clearance between the bottom head of the digester and ground can be substantially reduced, such as by one to two feet.

The outlet device 30 is not limited to application to continuous digesters, which are often large pressure vessels of over 100 feet, e.g., 30 meters, in height. The outlet device 30 may be applied to other pressure vessels in which there is a penetration of the shell of the vessel that can potentially result in leakage. The outlet device is particularly applicable to vessels, pressurized or unpressurized, which treat comminuted cellulosic fibrous material, for example, continuous digesters, batch digesters, impregnation vessels, or any other pre- or post-treatment vessels, including washing and bleaching vessels. The outlet device 30 is also applicable to any pressurized or unpressurized vessel having devices for introducing material to a vessel, for example, conventional top separators, as sold by, or any other form of agitator. The outlet device can also be used for mixers, degassing devices, or invasive instrumentation, for example, digester level indicators.

Figure 4A:
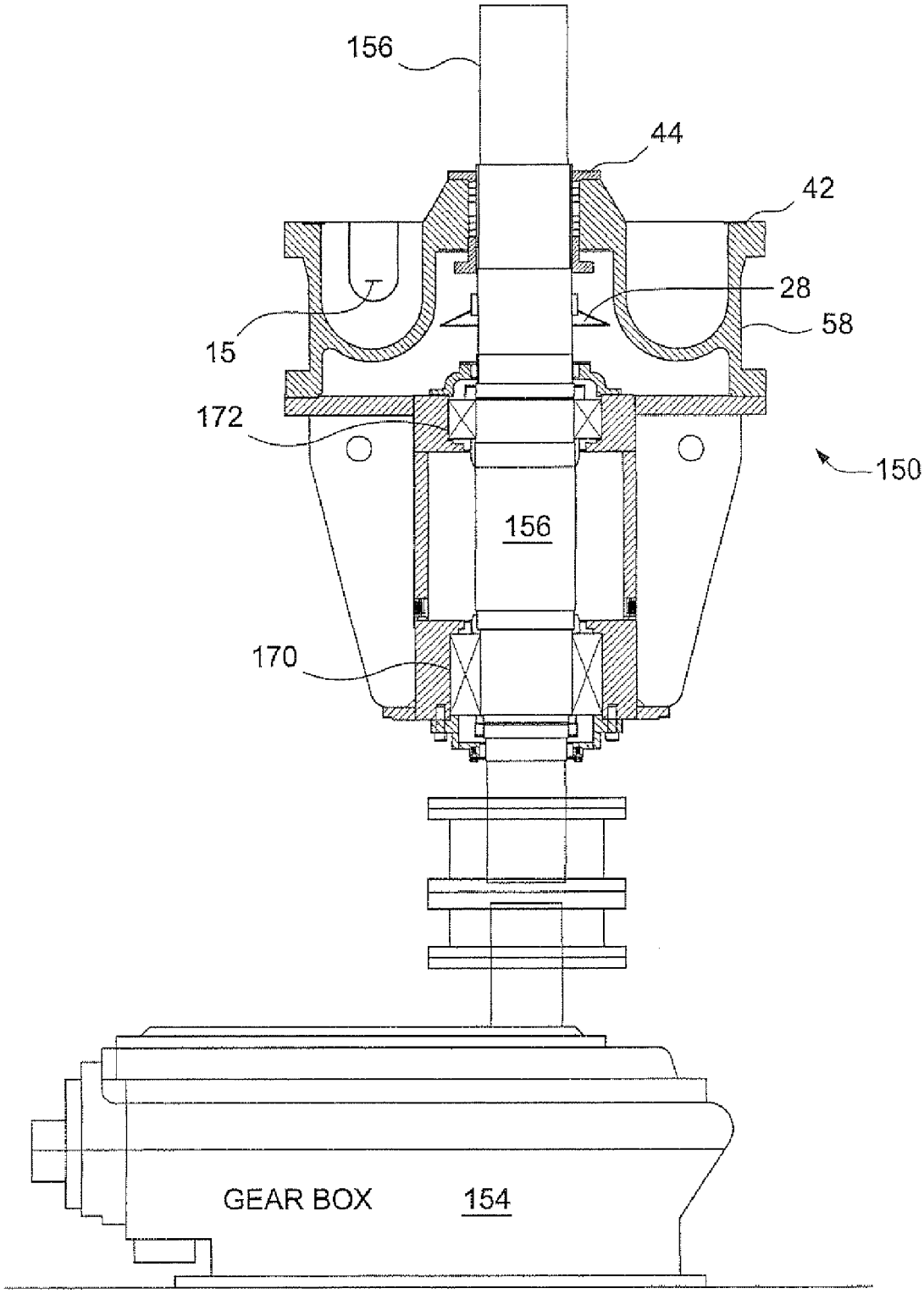
Figure 4A (Prior Art)
FIGS. 4A, 4B and 4C are comparable side views, partly in cross-section, of a conventional elongated drive shaft, outlet housing and speed reducing gear box (FIG. 4A), a conventional elongated drive shaft and outlet housing with a hydraulic motor (FIG. 4B), and a shorten drive shaft, short outlet housing outlet housing and hydraulic drive (FIG. 4C).
Figure 4B:
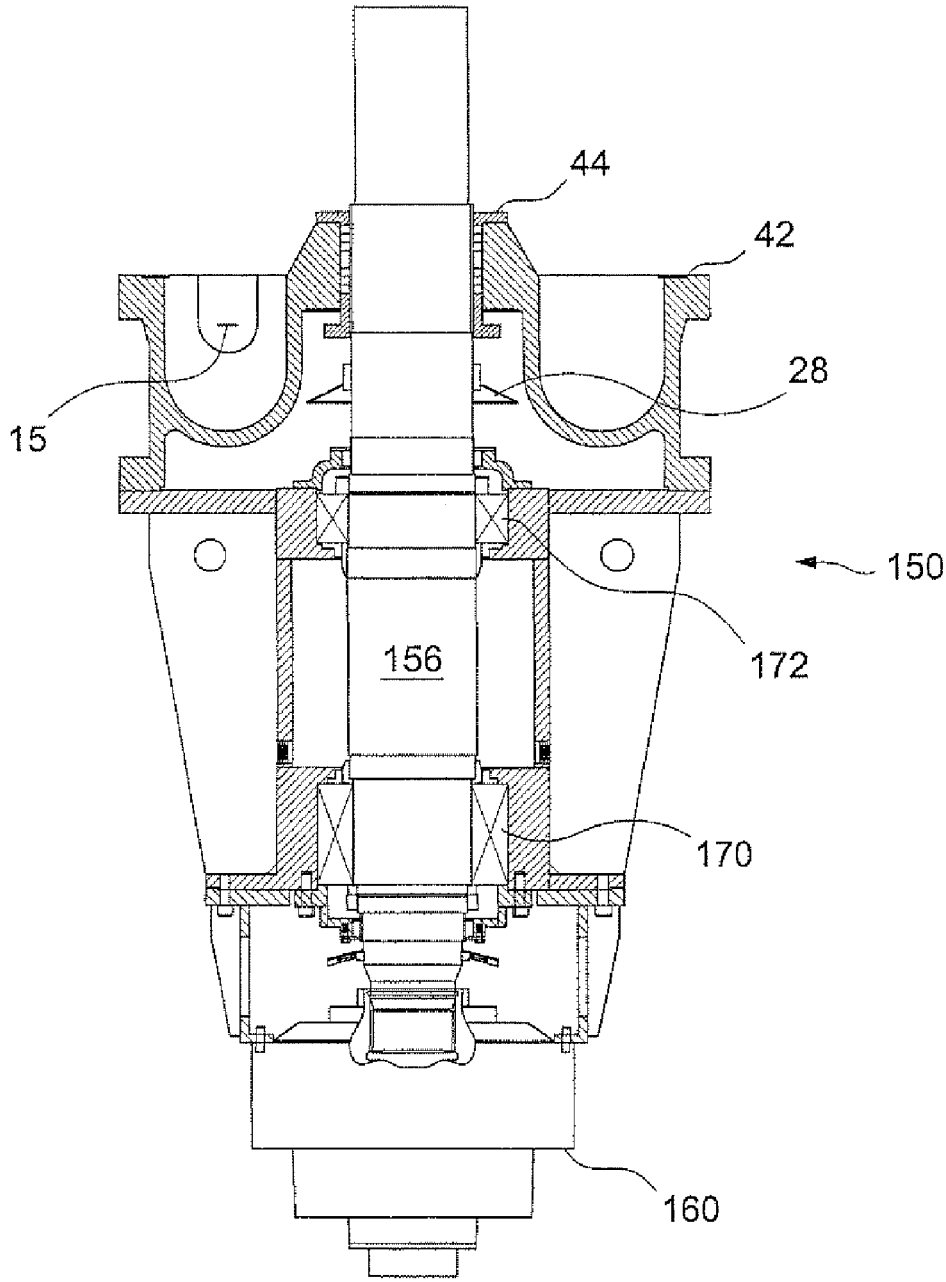
Figure 4B (Prior Art)
Figure 4C:
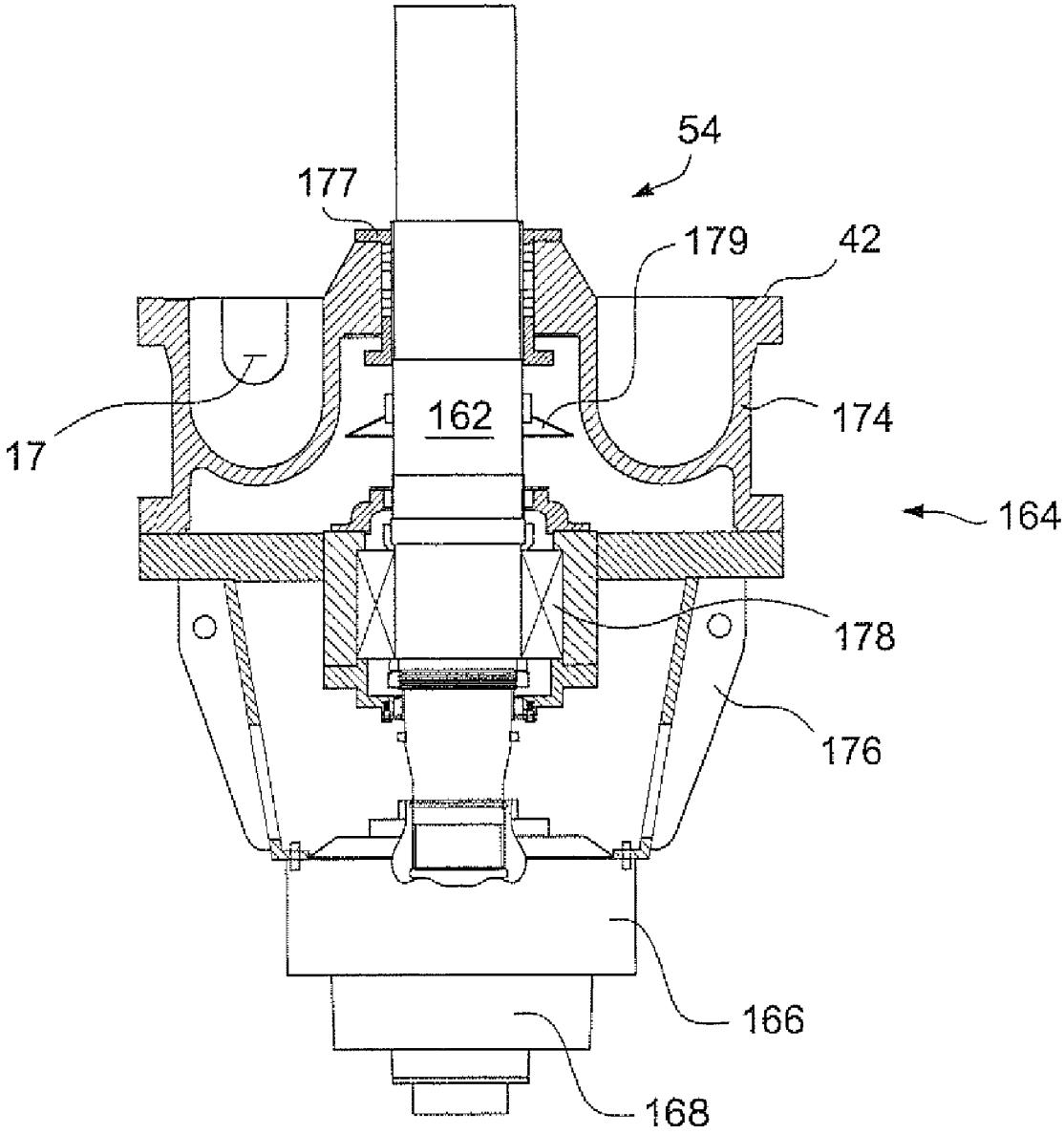

FIGS. 4A, 4B and 4C are comparable side views, partly in cross-section, of a conventional elongated drive shaft 156, outlet housing 150 and gear box assembly 154 (FIG. 4A); a conventional elongated drive shaft 156 and outlet housing 150 with a hydraulic motor assembly 160 (FIG. 4B), and a shorten drive shaft 162, short outlet housing 164, a hydraulic drive assembly 166 and a lower radial bearing 168 (FIG. 4C). The drive shaft, outlet housing and transmission assemblies shown in FIGS. 4A, 4B and 4C are comparable in that they are each of similar construction, with the exception of the differences in shaft length, outlet housing, bearings and transmissions, as is discussed below.

The conventional elongated drive shaft 156 and outlet housings 150 have an associated lower thrust-radial bearing 170 and an upper radial bearing 172. A conventional gear box 154 is coupled to the lower end of the elongated drive shaft 156. By replacing the gear box with a hydraulic motor 160 and retaining the same drive shaft 156 and outlet housing 150 (as shown in FIG. 4B), it is possible to reduce the overall length of the assembly of the drive shaft, outlet housing and transmission assembly (as evident from a comparison of FIGS. 4A and 4B). For example, the drive shaft 156, outlet housing 150 and gear box assembly 160 shown in FIG. 4A may have an exemplary length of ten feet, six inches, e.g., 3.5 meters. By way of comparison, the drive shaft 156, outlet housing 150 and hydraulic motor assembly 160 shown in FIG. 4B may have an exemplary length of eight feet, six inches, e.g., three meters. Accordingly, a reduction of two feet or nearly a meter in the height of the assembly of shaft, outlet housing and transmission assembly is achieved by using the hydraulic motor as shown in FIG. 4B.

A further reduction in the length of the assembly may be achieved with a short drive shaft 162, a short outlet housing 164 and a hydraulic motor assembly 166 with an integral radial bearing 168 (FIG. 4C) that has an exemplary length of six feet, six inches, e.g., two meters, which is four feet shorter (more than a meter) than the conventional assembly shown in FIG. 4A and two feet shorter than the conventional assembly shown in FIG. 4B.

The short outlet housing 164 has an upper flange 42 that couples to a bottom housing header of a vessel. The short outlet housing 164 may include an upper housing section 174 and a lower housing 176 that are fixed together, are stationary and attach to the vessel. The upper housing 174 may include a pulp outlet 15, a pack box 177 (alternatively the pack box may be included in the bottom header of the vessel to allow for a shorter outlet housing) and a conical flow diverter 179 around the shaft to shield the bearing assembly 178 from fluid on the shaft. The thrust bearing assembly 178, including roller bearings and a bearing housing, may be included in the lower housing section 176 and near the interface between the lower and upper housing sections.

The lower bearing assembly 168, e.g., a radial bearing having roller bearings, is below the hydraulic motor 168 and may or may not be integral with the hydraulic motor assembly 166. The separation between the lower radial bearing assembly 166 and the upper thrust bearing assembly 178 is sufficient to efficiently adsorb radial forces applied to the drive shaft and minimize wobble of the drive shaft during rotation. Further, the outlet housing 164 may be modified to include a wash liquor coupling such as shown in FIG. 3, without increasing the length of the drive shaft 162. For example, the pulp outlet 17 may be modified to accommodate a wash liquor coupling, as is shown in FIG. 3.

Figure 5:
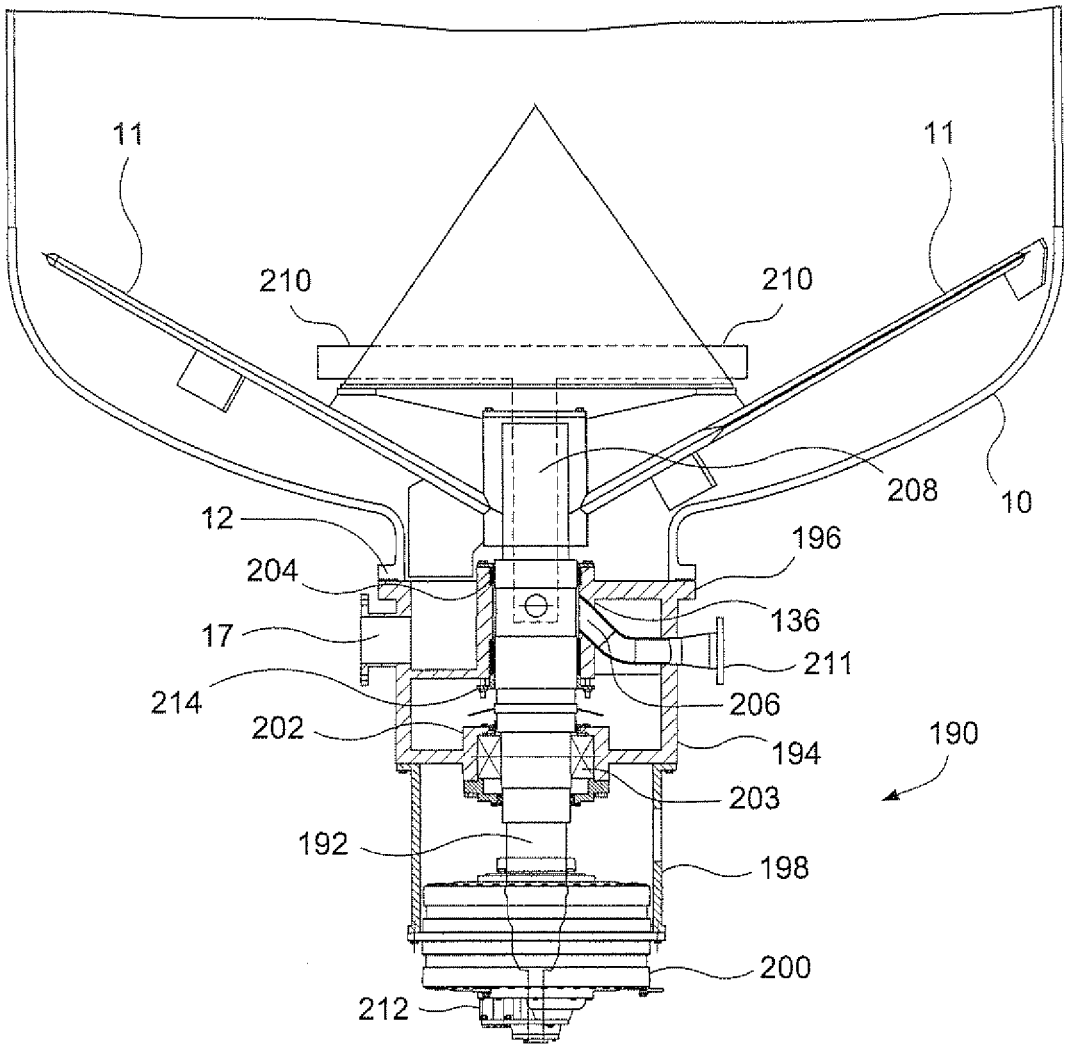
FIG. 5 a detailed side view, partly in cross-section and partly in elevation, of a short drive shaft, short outlet housing and a hydraulic drive.

FIG. 5 shows another alternative outlet device 190 having a short vertical drive shaft 192 extending through a bottom head 12 and into the digester vessel 10 to rotationally drive a scraper 11. Processed pulp and some liquor flow through the interior of the bottom head 12 and out the pulp outlet 17 at the bottom head of the digester.

The outlet device 190 includes a stationary outlet housing 194 that has an upper end flange 196 that connects to the bottom head 12 of the digester and a lower cylindrical housing 198 that is fixed to a hydraulic drive assembly 200, such as a hydraulic motor spline drive. The outlet housing 194 includes a thrust bearing assembly 202 that supports a thrust bearing 203. The thrust bearing 203 provides radial and axial support for the rotating drive shaft 192. The thrust bearing 203 and the outlet housing 194 adsorb and transfer the axial forces that act on the drive shaft from the upper digester to the outlet device 190 and thereby insulate the drive assembly 200 from most of these axial forces. The thrust bearing 203 and assembly 202 adsorb and transfer to the outlet housing 194 the radial forces that are applied to the drive shaft. While it is not necessary that the transmission be a hydraulic drive transmission, it is preferred that a hydraulic drive transmission be used. Nevertheless, a gear box transmission, electric motor with speed reducing belt drive and other may be used in conjunction with a shorten drive shaft with a bearing below the transmission or motor.

A bearing 204 may be mounted in the upper portion of the outlet housing and surround the drive shaft at the joint between the vessel and outlet device. The bearing may be an annular ring formed of a hard plastic material and split for installation around the drive shaft. The bearing 204 is held in place by an inner cylindrical sidewall of the outlet housing and facing the drive shaft. The bearing may adsorb a portion of radial forces applied to the drive shaft and transfer those forces to the outlet device.

Packing material in a single pack box 214 included in the outlet housing 194 provides a seal between the drive shaft and the interior of the outlet device and vessel of the digester. The pack box 214 extends immediately below the wash liquor conduit 206 to seal the shaft with respect to the conduit 206 and the vessel. The pack box is immediately below the wash liquor conduit. Further the wash liquor conduit is positioned immediately below the interface between the bottom header 12 and the upper flange 196 of the outlet housing 194. The pack box serves as a seal for both the wash liquid conduit (which provides wash water to the hollow conduit 208 in the shaft) and the pulp product in the vessel. Because a single pack box is used in the outlet device 190, the outlet housing can be shortened relative to conventional outlet housing that have at pack box for the vessel and a separate pack box for the wash liquid conduit.

The wash liquid conduit 206 receives wash liquid which flows to a hollow conduit 208 in the drive shaft and leading to wash liquid nozzles 210 above or into the hollow arms of the scraper 11. An inlet port 211 provides a coupling between the liquor conduit 206 to a source of wash liquor.

The hydraulic drive assembly 200 includes an integral radial bearing 212 that is preferable below the hydraulic drive mechanism or at the same elevation of the drive mechanism. The hydraulic drive assembly 200 applies torque to turn the drive shaft and rotate the scraper 11. The radial bearing 212 adsorbs radial forces, by transferring the forces to the outlet housing, acting on the shaft. The radial bearing in conjunction with the thrust bearing counteracts force moments that might otherwise cause the shaft to wobble or adversely affect the packing material due to radial movement of the shaft. The distance between the thrust bearing 203 and the radial bearing 212 is sufficient to counteract moments applied to the shaft 192 due to radial forces. The distance between bearings may be, for example, two to three feet.

By replacing a conventional gear box with a hydraulic motor drive and by doing away with a second bearing in the outlet device, and going to a single pack box design, the minimum clearance required between the bottom head of the digester and ground can be substantially reduced, such as by one to two feet. Within this reduced clearance, the outlet device 190 and the associated hydraulic drive assembly 200 may be coupled to a digester vessel that would otherwise not have sufficient clearing for an outlet device having a wash liquid conduit.

The outlet housing 194 may be added to an existing digester vessel to which it is desired to add a hydraulic drive, a wash liquor coupling or both. The addition of the outlet housing may or may not be in conjunction with shortening of the drive shaft. Once the existing outlet housing, transmission system and optionally the drive shaft have been removed, a new drive shaft is inserted into the bottom of the digester and secured to the scraper device. The drive shaft is extended through the outlet housing either before or after the drive shaft is secured to the scraper. Once the drive shaft is secured to the scraper, the upper flange of the outlet housing is fixed to the bottom head of the vessel. Alternatively, the outlet housing may be initially split into housing halves and assembled around the drive shaft and attached to the bottom head of the vessel. Packing material is applied to the pack box 214 to provide a seal between the vessel and the drive shaft.

If a counter-wash system is not added, the outlet housing may be shorter, e.g., by one foot or 33 centimeters, than if the outlet housing includes a conduit 206 for wash liquor. If the outlet housing 194 includes a wash liquor conduit 206, the conduit includes an outlet port 216 that is connected to a source of wash liquor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An outlet device and motor assembly for a pressured vessel comprising:

a generally vertical drive shaft extending below and through the vessel and coupled to a rotating mechanism within the vessel;

a stationary outlet housing supporting the drive shaft;

a thrust bearing mounted on the outlet housing and around the drive shaft to rotationally engage the drive shaft;

a hydraulic drive coupled to rotationally drive the drive shaft, and a radial bearing mounted around the drive shaft to rotationally engage the drive shaft and said radial bearing is at or below the hydraulic drive.

2. The outlet device of claim 1 wherein the hydraulic drive is a hydraulic motor spline drive connected to the drive shaft.

3. The outlet device of claim 1 wherein the thrust bearing and the radial bearing are separated by at least two feet along the length of the drive shaft.

4. The outlet device of claim 1 wherein the hydraulic drive is fixed to the outlet housing.

5. An outlet device and motor assembly for a pressured vessel comprising:

a generally vertical drive shaft extending below and through the vessel and coupled to a rotating mechanism within the vessel;

a stationary outlet housing supporting the drive shaft;

a thrust bearing mounted on the outlet housing and around the drive shaft to rotationally engage the drive shaft, and a hydraulic drive coupled to rotationally drive the drive shaft, wherein the hydraulic drive further comprises a radial bearing which supports the drive shaft.

6. The outlet device of claim 5 wherein the hydraulic drive is a hydraulic motor spline drive connected to the drive shaft and the radial bearing is below the hydraulic motor.

7. The outlet device of claim 5 wherein the thrust bearing is a singular bearing for the drive shaft in the outlet housing.

8. The outlet device of claims 5 wherein the hydraulic drive is fixed to the outlet housing.

9. A shaft outlet assembly and drive assembly for a digester comprising:

a rotatable shaft extending from the outlet assembly into a pressurized vessel of the digester;

a stationary outlet housing supporting the drive shaft;

a thrust bearing mounted in the outlet housing and around the drive shaft to rotationally engage the drive shaft, and a hydraulic drive coupled to rotationally drive the drive shaft, wherein the hydraulic drive includes a radial bearing which supports the drive shaft.

10. The shaft outlet assembly and drive assembly of claim 9 further comprising a pack box mounted on the vessel and having packing around the shaft.

11. The shaft outlet assembly and drive assembly of claim 9 wherein the hydraulic drive is a hydraulic motor spline drive connected to the drive shaft and the radial bearing is below the hydraulic motor.

12. The shaft outlet assembly and drive assembly of claim 9 wherein the thrust bearing is a singular bearing for the drive shaft in the outlet housing.

13. The shaft outlet assembly and drive assembly of claim 9 further comprising a wash liquor conduit in the outlet assembly and in fluid communication with a hollow conduit in the drive shaft for wash liquor, and said shaft outlet assembly includes a single pack box, wherein said pack box provides sealing for the vessel and the wash liquor conduit.

14. An outlet device and motor assembly for a pressured vessel comprising:

a generally vertical drive shaft extending below and through the vessel and coupled to a rotating mechanism within the vessel;

a stationary outlet housing supporting the drive shaft;

a thrust bearing mounted on the outlet housing and around the drive shaft to rotationally engage the drive shaft, and a hydraulic drive coupled to rotationally drive the drive shaft, wherein the hydraulic drive includes a radial bearing.

15. The outlet device of claim 14 wherein said hydraulic drive further comprises a radial bearing.

16. The outlet device of claim 14 wherein the outlet housing further comprises a second bearing engaging the shaft at a distance from the thrust bearing.

17. The outlet device of claim 14 wherein the outlet housing further comprises a second bearing engaging the shaft at a distance of at least one foot from the thrust bearing.

18. The outlet device of claim 14 further comprising a wash liquor conduit in the outlet assembly and in fluid communication with a hollow conduit in the drive shaft for wash liquor, and said shaft outlet assembly includes a single pack box, wherein said pack box provides sealing for the vessel and the wash liquor conduit.

* * * * *